US005419225A

United States Patent [19]

Fujita

[11] Patent Number: 5,419,225

[45] Date of Patent: May 30, 1995

[54] PUNCHING DIE

[75] Inventor: Oriya Fujita, Kanagawa, Japan

[73] Assignee: Amada Metrecs Company, Limited, Kanagawa, Japan

[21] Appl. No.: 189,660

[22] Filed: Feb. 1, 1994

[30] Foreign Application Priority Data

Feb. 3, 1993 [JP] Japan ..... 5-016184

[51] Int. Cl.[6] ..... B26F 1/14; B26D 7/26

[52] U.S. Cl. ..... 83/140; 83/588; 83/686; 83/698.91

[58] Field of Search ..... 83/140, 138, 139, 142, 83/143, 682, 683, 684, 685, 686, 687, 690, 691, 698.71, 698.91, 542, 588; 173/210, 211

[56] References Cited

U.S. PATENT DOCUMENTS

| | | | |
|---|---|---|---|
| 2,867,276 | 1/1959 | Taylor | 83/140 X |
| 2,983,176 | 5/1961 | Taylor | 83/138 |
| 3,147,657 | 9/1964 | Williamson | 83/140 |
| 3,211,035 | 10/1965 | Whistler, Sr. et al. | 83/139 |
| 3,342,091 | 9/1967 | Schott et al. | 83/140 |
| 3,429,212 | 2/1969 | Weisbeck | 83/140 |
| 3,622,067 | 11/1971 | Bucy et al. | 83/917 X |
| 3,683,735 | 8/1972 | Achler et al. | 83/138 X |
| 3,741,056 | 7/1973 | Saladin et al. | 83/140 |
| 3,765,285 | 10/1973 | Achler et al. | 83/138 X |
| 3,815,459 | 6/1974 | Daniels | 83/140 |
| 3,926,082 | 12/1975 | von Langendorff | 83/140 |
| 3,958,476 | 5/1976 | Bartha | 83/143 |
| 4,248,111 | 2/1981 | Wilson et al. | 83/140 |
| 4,280,383 | 7/1981 | Bryan et al. | 83/140 |
| 4,457,196 | 7/1984 | Cady | 83/140 |
| 4,843,931 | 7/1989 | Whister | 83/138 |
| 4,856,393 | 10/1989 | Braddon | 83/138 X |
| 4,862,782 | 9/1989 | Ernst | 83/140 X |
| 4,977,804 | 12/1990 | Naito | 83/129 X |
| 5,020,407 | 6/1991 | Brinlee | 83/686 X |
| 5,042,352 | 8/1991 | Lux | 83/140 X |
| 5,176,057 | 1/1993 | Chun et al. | 83/140 X |
| 5,269,213 | 12/1993 | Coneski et al. | 83/588 X |
| 5,329,835 | 7/1994 | Timp et al. | 83/686 |

FOREIGN PATENT DOCUMENTS

| | | |
|---|---|---|
| 2921098 | 7/1980 | Germany . |
| 3-4318 | 1/1991 | Japan . |

*Primary Examiner*—Rinaldi I. Rada
*Assistant Examiner*—Clark F. Dexter
*Attorney, Agent, or Firm*—Sandler Greenblum & Bernstein

[57] ABSTRACT

A punching die includes a punch body, a punch driver secured to the punch body, and a punch head provided on an upper portion of the punch driver for movement relative to the punch driver when the punch head is struck by a striker. The punch die further includes a punch guide fitted into the punch body, a stripper plate disposed at a lower portion of the punch guide, a stripping spring interposed between the punch guide and a flange portion of the punch driver, and an elastically deformable damping member interposed between an upper surface of the punch driver and a lower surface of the punch head.

5 Claims, 3 Drawing Sheets

PUNCHING DIE

BACKGROUND OF THE INVENTION

1. Field of the Invention

The present invention relates to a punching die, and more specifically to a punching die which can prevent punching noise generated during punching processing of work.

2. Background Art

Generally, the punching processing is effected by moving up and down an upper die against work placed on a lower die. Therefore, whenever the work is punched out, punching noise is inevitably generated. In order to prevent the generation of the punching noise, generally a damping material such as urethane has been provided on a stripper plate disposed at the lower portion of a punch guide for constituting a part of the upper die.

In the general way of providing a damping material such as urethane on the stripper plate disposed at the lower portion of the punch guide, however, there exists a problem in that needle-shaped dust or refuse is inevitably produced during punching processing and further adheres onto the damping material or scratches the surface of the work to be punched out. In addition, there exist other problems in that the damping material is short in life time and difficult to be mounted at the bottom of the punching die.

SUMMARY OF THE INVENTION

With these problems in mind, therefore, it is the primary object of the present invention to provide a punching die provided with a damping member excellent in punching noise prevention performance, long in life time, and easy to be mounted on the punching die.

To achieve the above-mentioned object, the present invention provides a punching die including a punch body, a punch driver secured to the punch body, and a punch head provided for an upper portion of the punch driver. The punch head is struck by a striker. The punch die further includes a punch guide fitted to the punch body, a stripper plate disposed at a lower portion of the punch guide, a stripping spring interposed between the punch guide and a flange portion of the punch driver, and an elastically deformable damping member interposed between an upper surface of the punch driver and a lower surface of the punch head.

Further, it is preferable that the damping member is interposed in a first part of a space between the upper surface of the punch driver and the lower surface of the punch head, and is not interposed in another second part of the space. Moreover it is preferable that a distance between the upper surface and the lower surface in the first part is longer than a distance between the upper surface and the lower surface in the second part, in the second part the upper surface is spaced from the lower surface when the punch head is not struck by the striker In the punching die according to the present invention, when the punch guide is lowered so that the stripper plate collides against the work, it is possible to absorb a shock generated between both by the damping member.

Further, since the damping member is not excessively deformed by the presence of the dimension that a distance between the upper surface and the lower surface in the first part is longer than a distance between the upper surface and the lower surface in the second part. It is possible to make the life time of the damping member long and to transmit the punching force from the punch head to the punch driver certainly.

DETAILED DESCRIPTION OF THE PREFERRED EMBODIMENTS

An embodiment of the present invention will be described hereinbelow with reference to the attached drawings.

Figure 1:
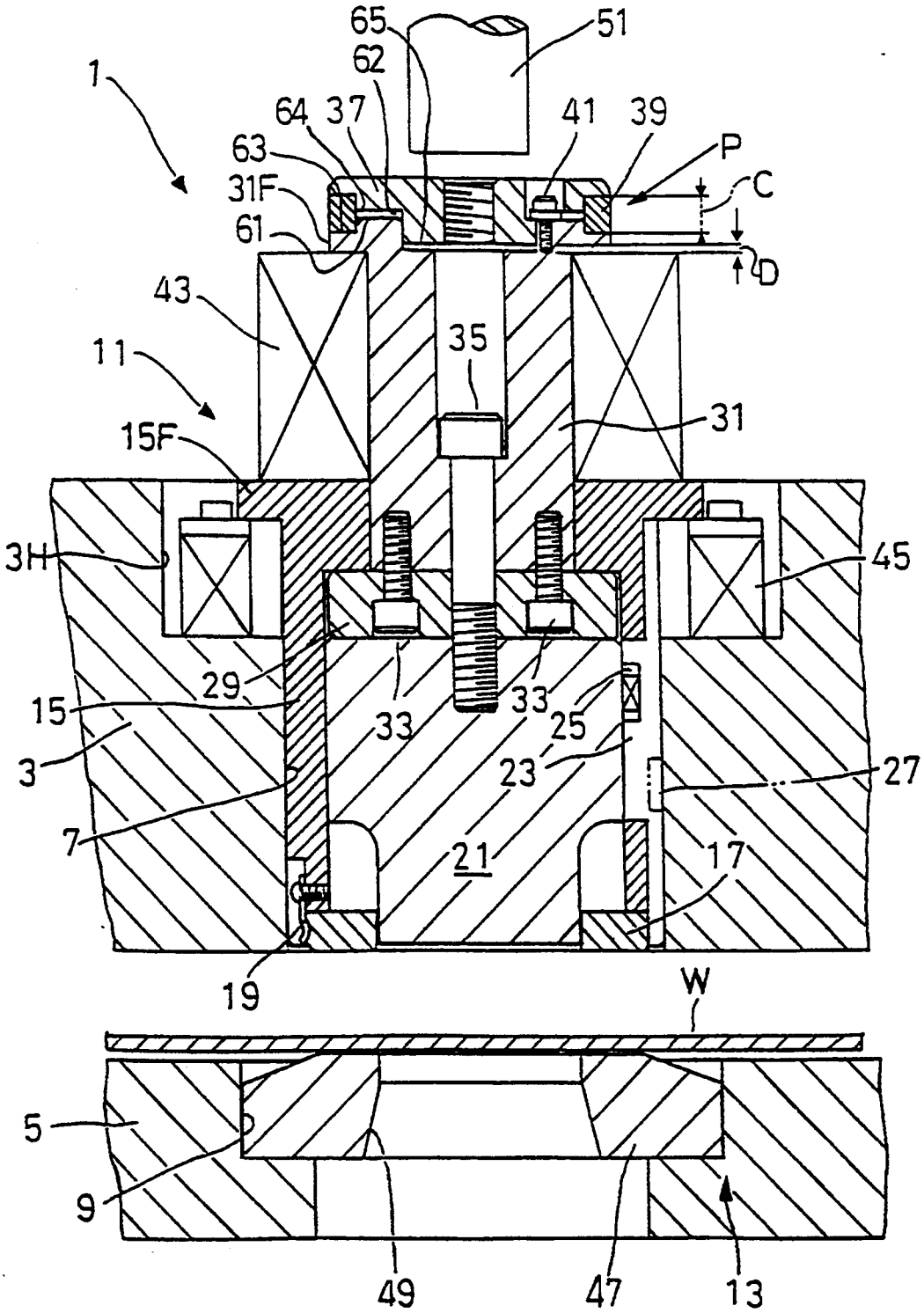
FIG. 1 is a cross-sectional view showing an embodiment of a turret punch press provided with a punching die according to the present invention.

In FIG. 1, a turret punch press 1, for instance is provided with a rotatable upper turret 3 and a rotatable lower turret 5 as upper and lower die holders, respectively. In the respective upper and lower turrets 3 and 5, a plurality of turret holes 7 and 9 are formed at appropriate angular intervals Along the circumferences of the turrets 3 and 5, respectively. A plurality of upper and lower dies 11 and 13 are fitted into the respective upper and lower turret holes 7 and 9, respectively.

FIG. 1 shows the state in which only one upper die 11 and only one lower die 13 are mounted on the upper turret 3 and the lower turret 5, respectively. In more detail with reference to FIG. 1, a punch guide 15 movable up and down and constituting a part of the upper die 11 is fitted to the turret hole 7. A stripper plate 17 is attached to the lower portion of the punch guide 15 with the use of mounting fixtures 19 and screws.

Further, a punch body 21 is fitted to the punch guide 15 so as to be movable up and down. Further, the punch guide 15 is formed with a key groove 23 so as to be engageable with a key 25 of the punch body 21 and another key 27 of the upper turret 3, respectively.

A punch driver 31 is provided on the upper portion of the punch body 21 via a circular plate 29. In more detail, the circular plate 29 and the punch driver 31 are fixed with a plurality of bolts 33, and further the punch body 21 and the punch driver 31 are fixed by a bolt 35.

A punch head 37 is provided on the upper portion of the punch driver 31. Further, an elastically deformable damping member 39 such as urethane is interposed between the upper surface 61 of a flange portion 31F of the punch driver 31 and the lower surface 62 of the punch head 37. The damping member 39 is interposed in an outer circumferential part 63 of a space 64 between the upper surface 61 and the lower surface 62, and is not interposed in a inner circumferential part 65 of the space 64.

The distance C between the upper surface 61 and the lower surface 62 in the outer circumferential part 63 is longer than the distance D between the upper surface 61 and the lower surface 62 in the inner circumferential part 65. In the inner circumferential part 65, the upper surface 61 is spaced from the lower surface 62 when the punch head 37 is not struck by the striker 51, so as to provide the stroke in which the damping member is deformed.

Figure 2:
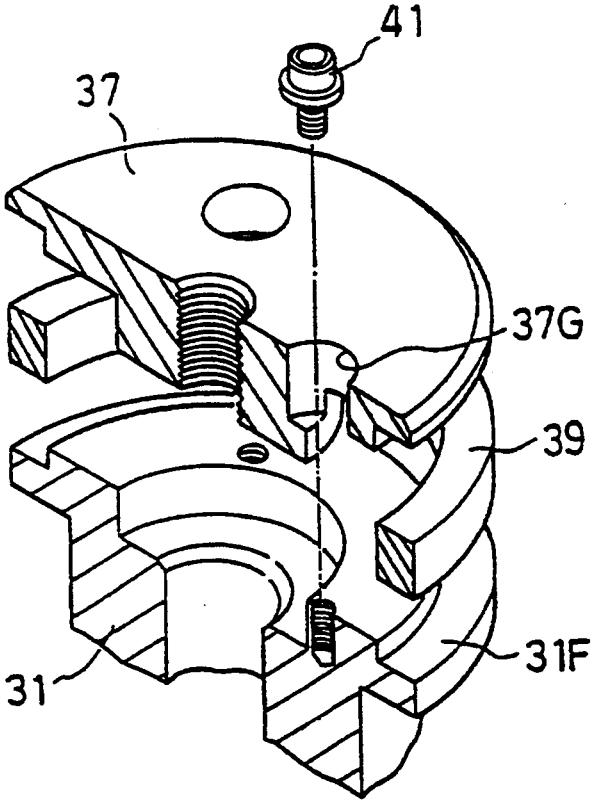
FIG. 2 is an enlarged perspective view showing the turret punch press when seen in the arrow direction P shown in FIG. 1.

Further, as depicted in FIG. 2, a bolt 41 is inserted into a groove 37G formed in the punch head 37 to fix the punch head 37 to the punch driver 31.

A stripping spring 43 is interposed between the upper surface of the punch guide 15 and the flange portion 31F of the punch driver 31 so as to always urge the punch driver 31 in the upward direction. In addition, a lift spring 45 is interposed between the flange portion 15F of the punch guide 15 and the bottom of a hole 3H formed in the upper turret 3 so as to always urge the punch guide 15 also in the upward direction.

Further, on the upper side of the punch head 37, a striker 51 movable up and down is attached on an upper frame (not shown) for constituting a part of the turret punch press.

On the other hand, a die 47 constituting the lower die 13 is fitted to the turret hole 9 of the lower turret 5. The lower die 47 is formed with a die hole 49 at a position directly under the punch body 21.

On the basis of the above-mentioned construction, when the striker 51 is lowered into collision against the punch head 37, the shock is first absorbed by the deformation of the lift spring 45. Thereafter, when the striker 51 is further lowered, the punch driver 31 is also lowered. As a result, the punch guide 15 is lowered by the downward motion of the punch driver 31 via the stripping spring 43 against the elastic force of the lift spring 45, and collides against the work W placed on the lower die 47. Then the shock is absorbed by the deformation of the damping member 39 interposed between the upper surface 61 of the punch driver 31 and the lower surface 62 of the punch head 37. Here, the reason why the lift spring 45 is compressed is that the spring constant of the lift spring 45 is determined to be smaller than that of the stripping spring 43. Further, even when the stripper plate 17 collides with the work W placed on the die 47, it is possible to absorb the shock by the damping member 39, thus preventing the punching noise generation.

In addition, an excessive deformation of the damping member 39 can be prevented by the presence of the dimension that the distance C in the outer circumferential part 63 is longer than the distance D in the inner circumferential part 65. In other words, since the punching force can be transmitted from the punch head 37 to the punch driver 31 through the damping member 39 within a predetermined deformation limit, it is possible to improve the life time of the damping member 39.

Figure 3:
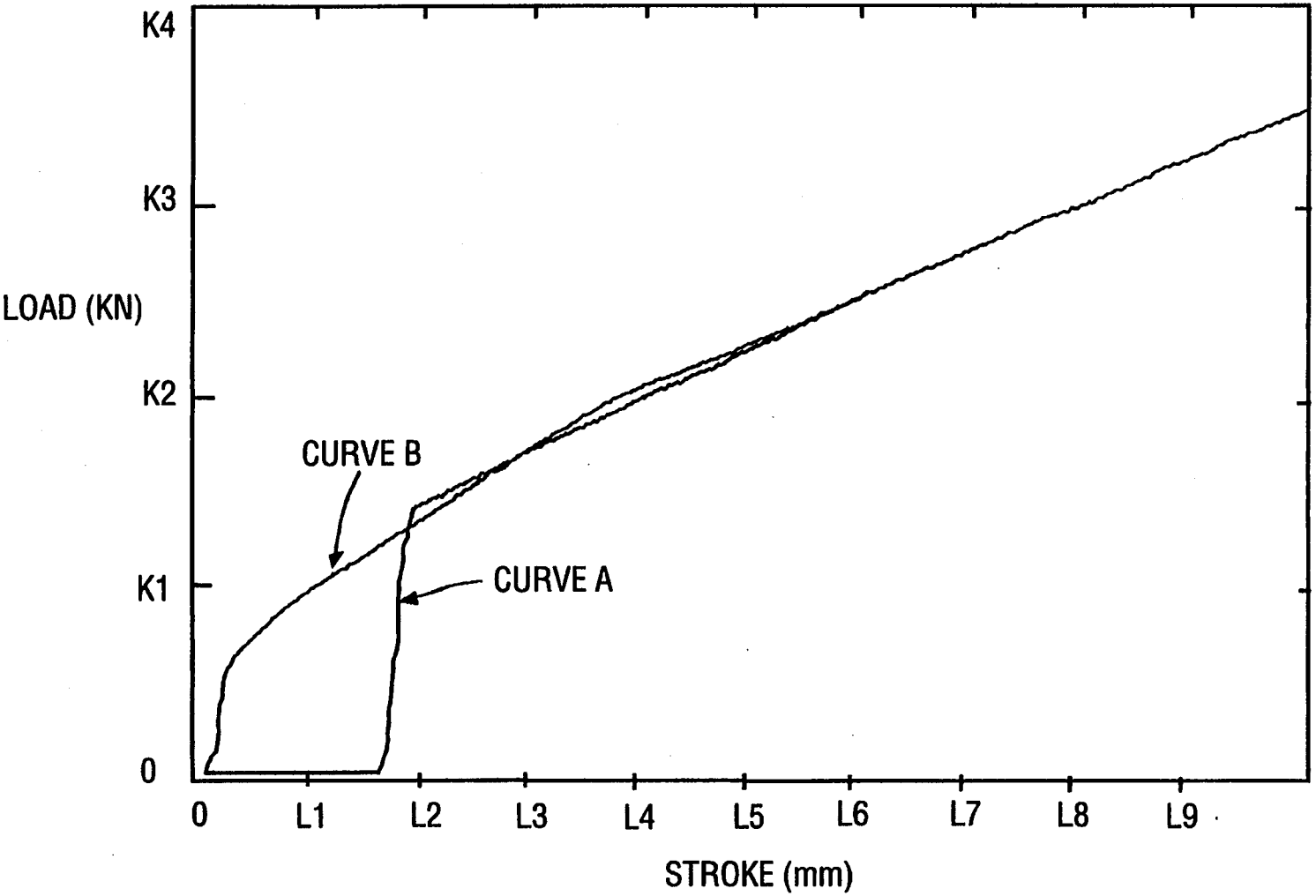
FIG. 3 is a graphical representation for assistance in explaining the shock load of the punching die according to the present invention.

When the stripper plate 17 collides with the work W, since two metallic members collide with each other under a very strong urging force of the stripping spring 43, the load applied by the stripping spring 43, the damping member 39, and the lift spring 45 increases abruptly as shown by a curve A in FIG. 3, so that a shock is generated. In the punching die of the present invention, since the damping member 39 is interposed between the upper surface 61 of the flange portion 31F of the punch driver 31 and the lower surface 62 of the punch head 37, it is possible to reduce the load applied by the stripping spring 43 as shown by a curve B in FIG. 3, so that a shock can be reduced effectively. Therefore, it is possible to prevent the generation of punching noise, as compared with the conventional punching die. Further, since the damping member 39 is interposed between the upper surface of the punch driver 31 and the lower surface of the punch head 37, the damping member 39 can be mounted easily.

The above-mentioned embodiment has been described only by way of example. Without being limited thereto, however, various modifications may be made. For instance, in the embodiment shown in FIG. 1, the damping member 39 does not exist between the upper surface 61 and the lower surface 62 in the inner circumferential part 65. But even if the damping member 39 is disposed extending into the space between the upper surface 61 and the lower surface 62 in the inner circumferential part 65, it is possible to obtain the same damping effect as with the case of the above-mentioned embodiment.

As described above, in the punching die according to the present invention, since the elastically deformable damping member is interposed between the upper surface of the punch driver and the lower surface of the punch head, it is possible to prevent the generation of the punching noise effectively, while making the life time of the damping member long and facilitating the mounting process of the damping member on the punching die.

What is claimed is:

1. A punching die comprising:

a punch body;

a punch driver secured to said punch body;

a punch head movably mounted on an upper portion of said punch driver, said punch head being movable toward and away from said punch driver without rotation of said punch head, such that said punch head moves toward said punch driver when said punch head is struck by a striker;

a punch guide fitted around and in slidable contact with said punch body;

a stripper plate disposed at a lower portion of said punch guide;

a stripping spring interposed between said punch guide and a flange portion of said punch driver; and an elastically deformable damping member interposed between an upper surface of said punch driver and a lower surface of said punch head said damping member spacing said punch head from said punch driver when said punch head is not being struck by said striker.

2. The punching die of claim 1, wherein:

said damping member is interposed in a first part of a space between said upper surface of said punch driver and said lower surface of said punch head, and is not interposed in a second part of said space.

3. The punching die of claim 2, wherein:

said first part is an outer circumferential part of said space and said second part is an inner circumferential part of said space.

4. The punching die of claim 2, wherein:

a distance between said upper surface and said lower surface in said first part is longer than a distance between said upper surface and said lower surface in said second part, and said second part of said upper surface is spaced from said lower surface when said punch head is not struck by said striker.

5. The punching die of claim 1, wherein:

said elastically deformable damping member is formed of urethane.

* * * * *

UNITED STATES PATENT AND TRADEMARK OFFICE

CERTIFICATE OF CORRECTION

PATENT NO. : 5,419,225

DATED : May 30, 1995

INVENTOR(S) : Oriya FUJITA

It is certified that error appears in the above-indentified patent and that said Letters Patent is hereby corrected as shown below:

At column 2, line 28, change "Along" to ---along---.

At column 4, line 42 (claim 1, line 18), change "head" to ---head,---.

Signed and Sealed this

Seventeenth Day of September, 1996

*Attest:*

*Attesting Officer*

BRUCE LEHMAN

*Commissioner of Patents and Trademarks*